US008955239B1

(12) United States Patent
Wiley

(10) Patent No.: US 8,955,239 B1
(45) Date of Patent: Feb. 17, 2015

(54) SMALL CLOTHES IRON FOR USE WITH CHILDREN'S CLOTHES

(71) Applicant: James T. Wiley, Riverdale, GA (US)

(72) Inventor: James T. Wiley, Riverdale, GA (US)

( * ) Notice: Subject to any disclaimer, the term of this patent is extended or adjusted under 35 U.S.C. 154(b) by 0 days.

(21) Appl. No.: 13/717,911

(22) Filed: Dec. 18, 2012

(51) Int. Cl.

| | |
|---|---|
| ***D06F 75/36*** | (2006.01) |
| ***D06F 75/30*** | (2006.01) |
| ***D06F 75/14*** | (2006.01) |
| *D06F 75/18* | (2006.01) |

(52) U.S. Cl.
CPC ..... *D06F 75/30* (2013.01); *D06F 75/14* (2013.01)
USPC ..... 38/88; 38/77.83

(58) Field of Classification Search
USPC ..... 38/74–77.83, 82–85, 88–90, 93; D32/68–72
See application file for complete search history.

(56) References Cited

U.S. PATENT DOCUMENTS

| | | | | | |
|---|---|---|---|---|---|
| D18,694 | S | * | 10/1888 | Cosby | D32/68 |
| 2,497,744 | A | * | 2/1950 | Sorkin | 446/474 |
| 2,607,139 | A | | 8/1952 | Snyder et al. | |
| D212,700 | S | | 11/1968 | Teleki | |
| 3,676,950 | A | * | 7/1972 | Clarke | 446/474 |
| 4,283,701 | A | * | 8/1981 | Ryckman, Jr. | 337/341 |
| 4,640,028 | A | * | 2/1987 | Nakada et al. | 38/77.7 |
| 4,856,212 | A | | 8/1989 | Dikoff | |
| 4,948,945 | A | | 8/1990 | Wu | |
| 5,019,010 | A | * | 5/1991 | Nikaido et al. | 446/487 |
| 5,901,481 | A | | 5/1999 | Simmons et al. | |
| D587,418 | S | | 2/2009 | Mizoguchi | |
| 2004/0082258 | A1 | * | 4/2004 | Kim | 446/85 |

* cited by examiner

*Primary Examiner* — Ismael Izaguirre

(57) ABSTRACT

The small clothes iron for use with children's clothes is a small iron when compared to a traditional clothes iron. The small clothes iron resembles a toy train wherein a front surface resembles a face of a toy character while a top surface includes a handle, control buttons, and a chimney/smokestack for refilling a water reservoir. The small clothes iron has a smaller iron surface on a bottom surface, which is useful in ironing small clothes for children and infants.

3 Claims, 4 Drawing Sheets

SMALL CLOTHES IRON FOR USE WITH CHILDREN'S CLOTHES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of clothes iron, more specifically, a clothes iron that is particularly suited for use with children's clothes.

B. Discussion of the Prior Art

As will be discussed immediately below, no prior art discloses a small clothes iron that is specifically adapted for use with children's or baby's clothes; wherein the small clothes iron resembles a toy train, and is able to iron small, clothes; wherein the iron includes a water cap that resembles a toy train chimney/smokestack is responsible for accessing the water reservoir provided inside of the housing of the small iron; wherein the ironing surface is located under said housing, and is obviously used to engage against the clothing to be ironed.

The Simmons et al. Patent (U.S. Pat. No. 5,901,481) discloses an ironing device that is specifically designed for ironing small apparel, such clothing for infants and toddlers. However, the ironing device does not resemble a toy train while operating as a clothes iron that includes a smaller ironing surface that is suitable for use with children's clothing.

The Snyder Patent (U.S. Pat. No. 2,607,139) discloses an electric iron assembly. Again, the iron assembly does not resemble that of a toy train while functionally capable of ironing clothes with a small ironing surface.

The Dikoff Patent (U.S. Pat. No. 4,856,212) discloses a cordless iron. Again, the cordless iron does not resemble a toy train that includes a small ironing surface that is able to uniquely iron small articles of clothing.

The Wu Patent (U.S. Pat. No. 4,948,945) discloses an electric ironing device with a power supply connector arrangement that permits either corded or cordless operation. Again, the ironing device is not a small clothes iron that is designed to resemble a toy train.

The Mizoguchi Patent (U.S. Pat. No. Des. 587,418) illustrates an ornamental design for a steam iron, which does not resemble a toy train.

The Teleki Patent (U.S. Pat. No. Des. 212,700) illustrates an ornamental design for a toy flat iron, which does not resemble a toy train.

While the above-described devices fulfill their respective and particular objects and requirements, they do not describe a small clothes iron that is specifically adapted for use with children's or baby's clothes; wherein the small clothes iron resembles a toy train, and is able to iron small clothes; wherein the iron includes a water cap that resembles a toy train chimney/smokestack is responsible for accessing the water reservoir provided inside of the housing of the small iron; wherein the ironing surface is located under said housing, and is obviously used to engage against the clothing to be ironed. In this regard, the small clothes iron for use with children's clothes departs from the conventional concepts and designs of the prior art.

SUMMARY OF THE INVENTION

The small clothes iron for use with children's clothes is a small iron when compared to a traditional clothes iron. The small clothes iron resembles a toy train wherein a front surface resembles a face of a toy character while a top surface includes a handle, control buttons, and a chimney/smokestack for refilling a water reservoir. The small clothes iron has a 19 smaller iron surface on a bottom surface, which is useful in ironing small clothes for children and infants.

It is an object of the invention to provide a small clothes iron that has an ironing surface that is smaller in size, which is ideal for use in ironing small clothes.

A further object of the invention is to provide a small clothes iron that resembles a toy train in appearance.

An even further object of the invention is to include a front surface that resembles a face of a toy train character.

An even further object of the invention is to include a chimney or smokestack that aids in resembling a toy train, but is the conduit for re-filling a water reservoir that is associated with producing steam that is used when ironing.

These together with additional objects, features and advantages of the small clothes iron for use with children's clothes will be readily apparent to those of ordinary skill in the art upon reading the following detailed description of presently preferred, but nonetheless illustrative, embodiments of the small clothes iron for use with children's clothes when taken in conjunction with the accompanying drawings.

In this respect, before explaining the current embodiments of the small clothes iron for use with children's clothes in detail, it is to be understood that the small clothes iron for use with children's clothes is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the small clothes iron for use with children's clothes.

It is therefore important that the claims be regarded as including such equivalent construction insofar as they do not depart from the spirit and scope of the small clothes iron for use with children's clothes. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
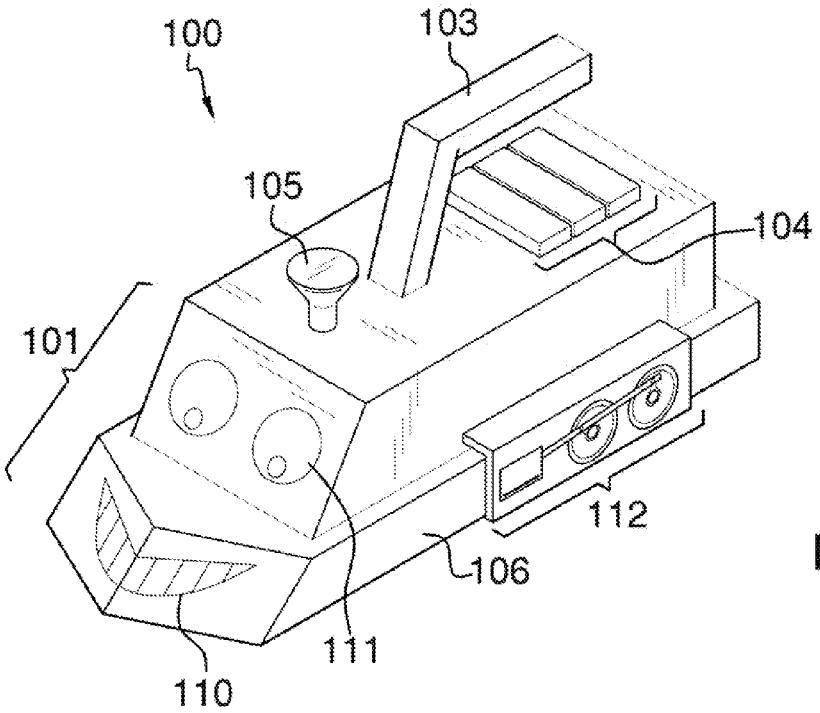
FIG. 1 illustrates a perspective view of the small clothes iron by itself.
Figure 2:
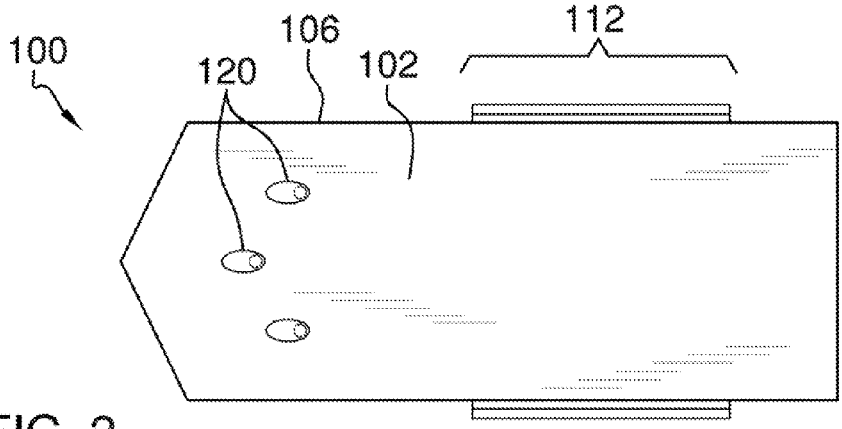
FIG. 2 illustrates a bottom view of the small clothes iron wherein steam holes are presented towards a front end of the ironing surface.
Figure 3:
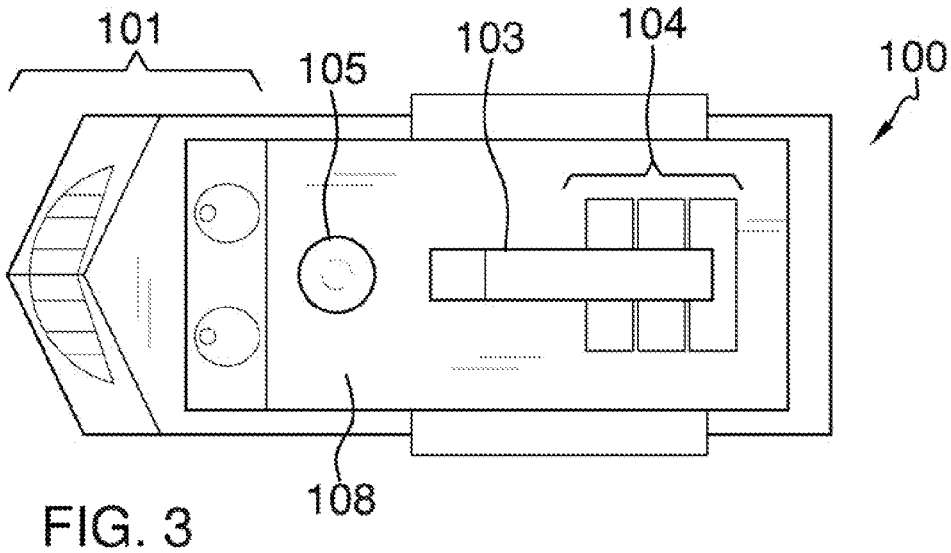
FIG. 3 illustrates a top view of the small clothes iron by itself.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A small clothes iron for use with children's clothes 100 (hereinafter invention) includes a front surface 101, a bottom surface 102, a handle 103, a plurality of controls 104, a chimney or smokestack 105, and side surfaces 106. The invention 100 is made to resemble a toy train, and includes depictions as such on the front surface 101 and the side surfaces 106. Moreover, the front surface 101 resembles a face of a toy train character as denoted by a smile 110 and eyes 11. The side surfaces 106 include train wheel indicia 112 thereon. The combination of the train wheel indicia 112, the chimney or smokestack 105, the smile 110 and the eyes 111 gives the overall appearance of the toy train.

The bottom surface 102 includes an iron surface that is suited for use in ironing clothes, and has a surface area that is much less than a typical ironing surface. Moreover, the area of the bottom surface 102 includes steam outlets 120 thereon, which are customary with a traditional iron. The invention 100 as previously mentioned is specifically designed for use with small clothing 300. In referring to FIG. 6, the invention 100 is designated for use with a small child's t-shirt. The bottom surface 102 shall have a surface area of not more than 12 square inches, which shall preserve the overall size being dedicated to perform ironing services associated with small clothing.

Figure 4:
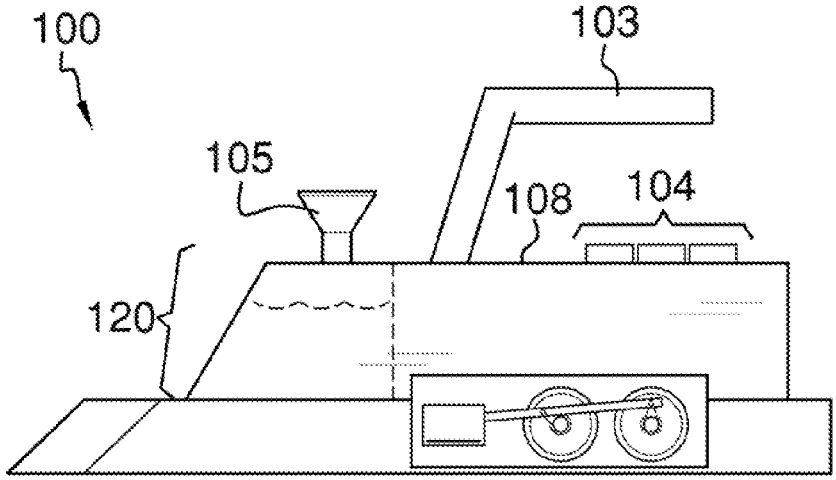
FIG. 4 illustrates a detailed side view depicting the water reservoir is partially filled and depicting the fluid communication with the chimney/smokestack portion of the toy train motif.
Figure 5:
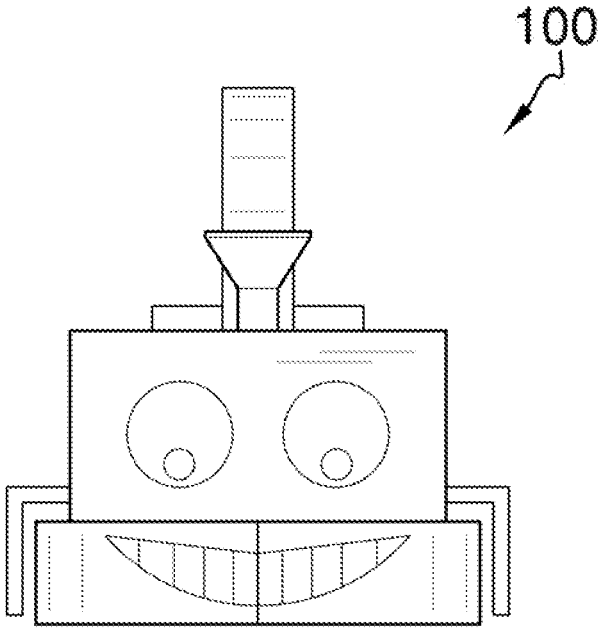
FIG. 5 illustrates a front end view of the small clothes iron depicting the face portion of the small clothes iron.
Figure 6:
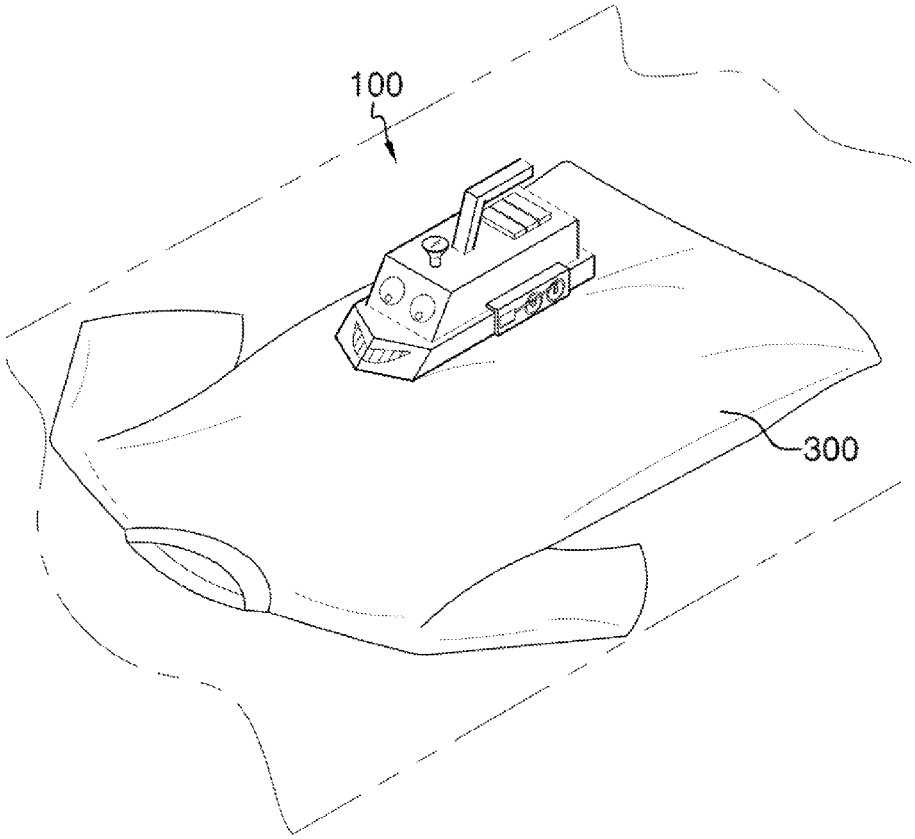
FIG. 6 illustrates a perspective view of the small clothes iron in use with an item of small clothing that is a child shirt.

The chimney or smokestack 105 may also be referred to as the chimney 105. Referring to FIG. 4, the chimney 105 is a water conduit that provides fluid communication to a water reservoir 120 that is located inside of the invention 100. The chimney 105 is designed to resemble the chimney portion of a toy train, and doubles as the means with which to refill the water reservoir 120. The water reservoir 120 is included with the invention 100, and is customary with an iron as the component that enables water to be stored before being used as steam when ironing.

The handle 103 extends upwardly from a top surface 108. The handle 103 extends rearwardly and provides the means with which to hold and articulate the invention 100. The plurality of controls 104 are located behind the handle 103. The plurality of controls 104 are further located on the top surface 108 of the invention 100. The plurality of controls 104 is being used to loosely refer to the buttons typically associated with an iron, and which generally involve a plurality of heat settings that may be selected to adjust the output temperature of the iron surface located on the bottom surface 102.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A small clothes iron for use with children's clothing comprising:

a front surface, a bottom surface, a handle, a plurality of controls, a chimney, and side surfaces;

wherein the small clothes iron is designed to resemble a toy train while including an ironing surface on the bottom surface;

wherein the bottom surface has a surface area that is small and is useful in ironing small clothing;

wherein the front surface is adorned with a smile and eyes in order to resemble a toy train character;

wherein the side surfaces include train wheel indicia thereon;

wherein the bottom surface includes steam outlets thereon;

wherein the chimney is a water conduit that provides fluid communication to a water reservoir that is located inside of the small clothes iron; wherein the chimney enables the water reservoir to be refilled as needed;

wherein the handle extends upwardly as well as rearwardly from a top surface;

wherein the plurality of controls are located behind the handle; wherein the plurality of controls are further located on the top surface.

2. The small clothes iron as described in claim 1 wherein the bottom surface has a surface area of less than 12 square inches.

3. A small clothes iron for use with children's clothing comprising:

a front surface, a bottom surface, a handle, a plurality of controls, a chimney, and side surfaces;

wherein the small clothes iron is designed to resemble a toy train while including an ironing surface on the bottom surface;

wherein the bottom surface has a surface area that is small and is useful in ironing small clothing;

wherein the front surface is adorned with a smile and eyes in order to resemble a toy train character;

wherein the side surfaces include train wheel indicia thereon;

wherein the bottom surface includes steam outlets thereon;

wherein the chimney is a water conduit that provides fluid communication to a water reservoir that is located inside of the small clothes iron; wherein the chimney enables the water reservoir to be refilled as needed;

wherein the handle extends upwardly as well as rearwardly from a top surface;

wherein the plurality of controls are located behind the handle; wherein the plurality of controls are further located on the top surface;

wherein the bottom surface has a surface area of less than 12 square inches.

* * * * *